US008550773B2

(12) United States Patent
Almstedt et al.

(10) Patent No.: US 8,550,773 B2
(45) Date of Patent: Oct. 8, 2013

(54) STEAM TURBINE HAVING BEARING STRUTS

(75) Inventors: Henning Almstedt, Mülheim an der Ruhr (DE); Stefan Essink, Emmerich (DE); Norbert Pieper, Duisburg (DE); Mark-Andre Schwarz, Xanten (DE); Kais Sfar, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 1051 days.

(21) Appl. No.: 12/085,699

(22) PCT Filed: Nov. 30, 2006

(86) PCT No.: PCT/EP2006/069094

§ 371 (c)(1),
(2), (4) Date: Sep. 22, 2009

(87) PCT Pub. No.: WO2007/063088

PCT Pub. Date: Jun. 7, 2007

(65) Prior Publication Data

US 2010/0054927 A1 Mar. 4, 2010

(30) Foreign Application Priority Data

Dec. 1, 2005 (EP) ..... 05026254

(51) Int. Cl.
*F01D 25/16* (2006.01)

(52) U.S. Cl.
USPC ..... 415/112; 415/116; 415/175; 415/180

(58) Field of Classification Search
USPC ..... 415/110, 111, 112, 115, 116, 117, 415/175, 176, 180
See application file for complete search history.

(56) References Cited

U.S. PATENT DOCUMENTS

| | | | | |
|---|---|---|---|---|
| 5,388,960 | A * | 2/1995 | Suzuki et al. | 415/176 |
| 5,819,525 | A * | 10/1998 | Gaul et al. | 60/806 |
| 6,224,327 | B1 * | 5/2001 | Aoki et al. | 415/115 |
| 6,450,758 | B1 * | 9/2002 | Schmidt | 415/115 |
| 6,637,208 | B2 * | 10/2003 | Horner | 60/785 |
| 6,872,047 | B2 * | 3/2005 | Tanioka | 415/114 |
| 7,114,915 | B2 * | 10/2006 | Uematsu et al. | |
| 7,267,525 | B2 * | 9/2007 | Hiegemann et al. | 415/115 |

FOREIGN PATENT DOCUMENTS

| | | | |
|---|---|---|---|
| CH | 685448 | A5 | 7/1995 |
| EP | 0509802 | A1 | 10/1992 |
| GB | 623615 | A * | 5/1949 |
| GB | 819111 | A * | 8/1959 |
| GB | 1455974 | A | 11/1976 |

* cited by examiner

*Primary Examiner* — Edward Look
*Assistant Examiner* — Aaron R Eastman

(57) ABSTRACT

A steam turbine having an exhaust-steam casing for directing an exhaust-steam mass flow, a shaft bearing for mounting a turbine shaft, and at least two bearing struts, by means of which the shaft bearing is fastened to the exhaust-steam casing, is characterized according to the invention in that each of the at least two bearing struts has a cooling cavity arranged in the respective bearing strut for directing a coolant, and the cooling cavities of the at least two bearing struts are connected in a fluidically conductive manner via a closed-off connecting cavity in the region of the shaft bearing.

11 Claims, 4 Drawing Sheets

STEAM TURBINE HAVING BEARING STRUTS

CROSS REFERENCE TO RELATED APPLICATIONS

This application is the U.S. National Stage of International Application No. PCT/EP2006/069094, filed Nov. 30, 2006 and claims the benefit thereof. The International Application claims the benefits of European application No. 05026254.2 filed Dec. 1, 2005, both of the applications are incorporated by reference herein in their entirety.

FIELD OF INVENTION

The invention relates to a steam turbine with an exhaust steam casing for guiding an exhaust steam mass flow, a shaft bearing for supporting a turbine shaft, and also at least two bearing struts, by means of which the shaft bearing is fastened on the exhaust steam casing.

BACKGROUND OF THE INVENTION

With such steam turbines, the bearing struts are located directly in the exhaust steam mass flow. FIG. 4 shows a cross-sectional view of a load-carrying bearing strut 18 which is known from the prior art. This is constructed as a solid body, and has holes 34 for internal location of supply lines, such as seal-steam supply lines. Only a small clearance is provided between the supply lines and the bearing strut 18, for which reason an internal heat transfer takes place between the supply lines, especially seal-steam lines, and the bearing strut 18. Also, a heat input onto the bearing strut 18 takes place from outside as a result of the direct impingement with turbine exhaust steam. The temperature of the exhaust steam mass flow can vary greatly, depending upon operating point, as a result of which the deformation behavior of the bearing strut 18 is directly influenced. The bearing strut arrangements which are known in the prior art, therefore, are sensitive to temperature influences from inside and from outside. In the prior art, therefore, seal-steam temperatures are limited to values of below 150° C., and also large radial clearances are provided between the bearing struts and the exhaust steam casing or the shaft bearing.

An object upon which the present invention is based is to enhance a steam turbine of the type mentioned in the introduction to the effect that thermodynamic efficiency advantages for the entire turbine result.

SUMMARY OF INVENTION

This object is achieved according to the invention by a generic-type steam turbine in which each of the at least two bearing struts has a cooling cavity which is arranged in the respective bearing strut for guiding a cooling medium, and the cooling cavities of the at least two bearing struts are fluidically connected via a sealed connecting cavity in the region of the shaft bearing. As cooling medium, for example cooling air is a possibility, in which case the cooling cavities of the bearing struts are then formed as ventilation cavities which are exposed to throughflow of cooling air.

By the provision according to the invention of cooling cavities in the respective bearing struts, and by connecting these via a sealed connecting cavity in the region of the shaft bearing, the bearing struts can be effectively cooled from the inside by directing through a suitable cooling medium. In the case of cooling air as cooling medium, an internal cooling air flow through the bearing struts can be established by convection. In this case, ambient air is drawn in through at least one of the bearing struts, guided through the connecting cavity and discharged again to the environment via another bearing strut. In this way, the heat inside the bearing struts can be dissipated, and the influence of the temperature of the exhaust steam mass flow outside the bearing struts, and/or of the temperature of supply media which is guided inside the bearing struts, upon the deformation behavior of the bearing struts, can be minimized. As a consequence, the radial clearances for the shaft bearing and also for the exhaust steam casing can be designed smaller and less conservatively.

According to the invention, significant thermodynamic efficiency advantages for the entire turbine can be created. With realization of the cooling system according to the invention, the radial clearances can even be reduced in such a way that the bearing struts can be welded directly between the outer exhaust steam casing and an inner shaft seal housing of the shaft bearing. Furthermore, higher seal-steam temperatures in seal-steam lines, which are run inside the bearing struts, can now customarily be permitted than previously in the prior art. Seal-steam temperatures above 150° C. are possible in the case of the steam turbine according to the invention. This reduces the complexity of the seal-steam system and therefore saves costs in production and during maintenance.

In a preferred embodiment, the cooling cavities of the at least two bearing struts have in each case an opening which faces the exhaust steam casing. These openings are preferably arranged at the ends of the bearing struts which face the exhaust steam casing. As a result, cooling medium, such as cooling air, can enter the cooling system from outside the exhaust steam casing via the respective opening of one or more defined bearing struts, and discharge again into the environment via a corresponding opening on one or more bearing struts which is provided for it.

In order to operate the cooling of the bearing struts particularly efficiently, the cooling cavities of the at least two bearing struts and the connecting cavity form a pressure chamber which is sealed off from the exhaust steam mass flow of the steam turbine.

The shaft bearing advantageously has a shaft seal housing, and the connecting cavity is arranged inside the shaft seal housing. As a result, the flow dynamic of the exhaust steam mass flow is not influenced. In an alternative embodiment, the connecting cavity is formed by means of pipes which are guided outside a shaft seal housing. In a further embodiment which extends beyond it, the connecting cavity is formed inside the shaft bearing.

In an expedient embodiment, the connecting cavity is formed in passage form, especially as a passage system in star configuration in the case of at least three bearing struts. In this embodiment, the connecting cavity can transmit the cooling medium between the bearing struts particularly well.

At least one of the bearing struts is advantageously arranged in the lower section of the steam turbine, and therefore is formed as a load-carrying bearing strut. The cooling according to the invention of this load-carrying bearing strut by means of a cooling medium which is guided in a cooling cavity is particularly advantageous in the case of such a load-carrying bearing strut on account of the large mechanical forces which act upon it. In the case in which the shaft bearing is supported by means of at least three bearing struts, it is advantageous if at least two bearing struts are formed as load-carrying bearing struts and as a result are arranged in the lower section of the steam turbine. The weight of the turbine shaft which is mounted in the shaft bearing is consequently distributed to a plurality of bearing struts, which in turn enables a reduction of the radial clearances.

In an advantageous embodiment, the at least two bearing struts are formed in each case as a hollow body. In this case, the inside of the hollow body forms the corresponding cooling cavity. In this case, the cooling effect of the cooling medium, which is guided in the cooling cavity, upon the bearing strut is particularly high since this flows along the outer wall of the hollow body.

In a further advantageous embodiment, the cooling cavities extend in each case along at least one section of the corresponding strut surfaces in the longitudinal direction of the respective bearing strut. As a result, the cooling medium can be guided directly along the corresponding section of the strut surface, which enables an optimum cooling of this surface. Due to the extension of the cooling cavities in the longitudinal direction of the respective bearing strut, the cooling medium can be fluidically particularly simply guided through the related pressure chamber which is exposed to throughflow of the cooling medium.

In order to shield the load-carrying parts of the bearing struts from heat which is discharged from a seal-steam line, it is advantageous if at least one seal-steam line is arranged inside the ventilation passages.

In an advantageous embodiment, the steam turbine is formed as a low-pressure turbine with axial exhaust flow. With such steam turbines, the heat transfer as a result of the exhaust steam mass flow has a particularly negative effect upon the bearing struts in the case of embodiments which are used in the prior art. The cooling device which is provided according to the invention for the bearing struts of the low-pressure steam turbine enables a particularly advantageous increase of the thermodynamic efficiency due to reduction of the radial clearances, both during normal operation and during variable load operation of the turbine.

In a further advantageous embodiment, the shaft bearing is formed as a rear shaft bearing of the low-pressure steam turbine. The rear shaft bearing and also the load-carrying bearing struts of the low-pressure steam turbine are located directly in the low-pressure exhaust steam mass flow. As a result, the measures according to the invention have a particularly advantageous effect upon the thermodynamic efficiency of the steam turbine.

BRIEF DESCRIPTION OF THE DRAWINGS

An exemplary embodiment of a steam turbine according to the invention is subsequently explained in more detail with reference to the attached schematic drawings. In the drawing.

DETAILED DESCRIPTION OF INVENTION

Figure 1:
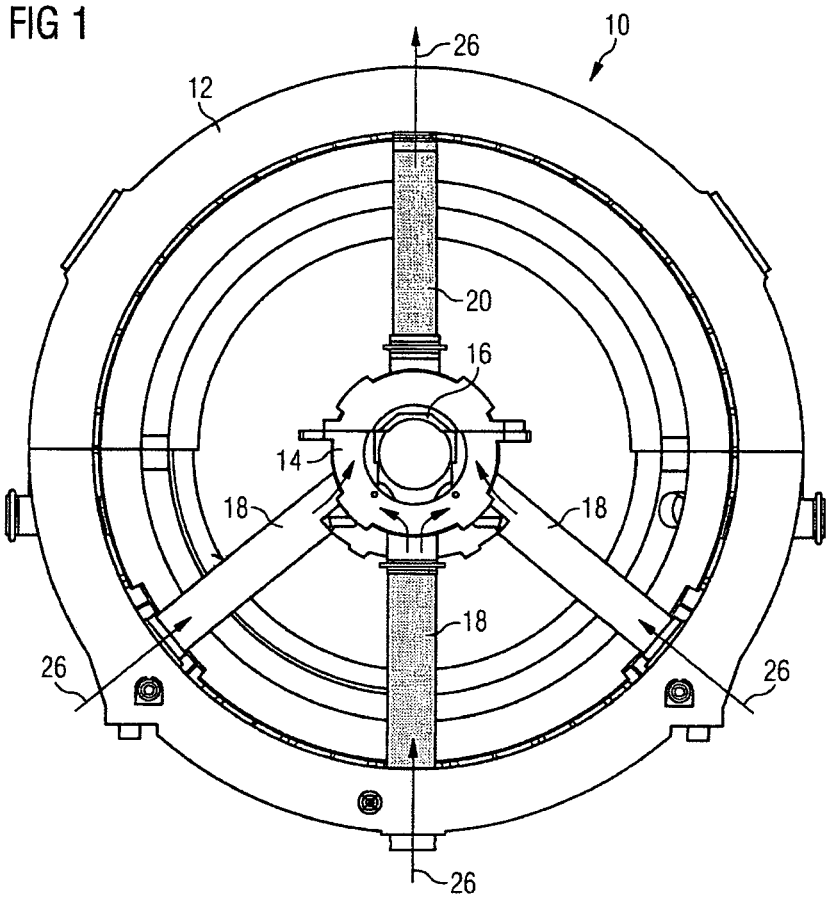
FIG. 1 shows a cross-sectional view of a low-pressure steam turbine according to the invention with a rear shaft bearing.

FIG. 1 shows the construction of a low-pressure steam turbine 10 according to the invention. The low-pressure steam turbine 10 has an outer exhaust steam casing 12 and an inner shaft seal housing 14. The shaft seal housing 14 includes a rear shaft bearing 16 for supporting a turbine shaft which is not shown in the drawing. The shaft seal housing 14 is fastened on the exhaust steam casing 12 via three lower load-carrying bearing struts 18 and also an upper bearing strut 20. For this purpose, the lower load-carrying struts 18 and also the upper bearing strut 20 are constructed as hollow bodies and are welded directly between the outer exhaust steam casing 12 and the inner shaft seal housing 14.

Figure 2:
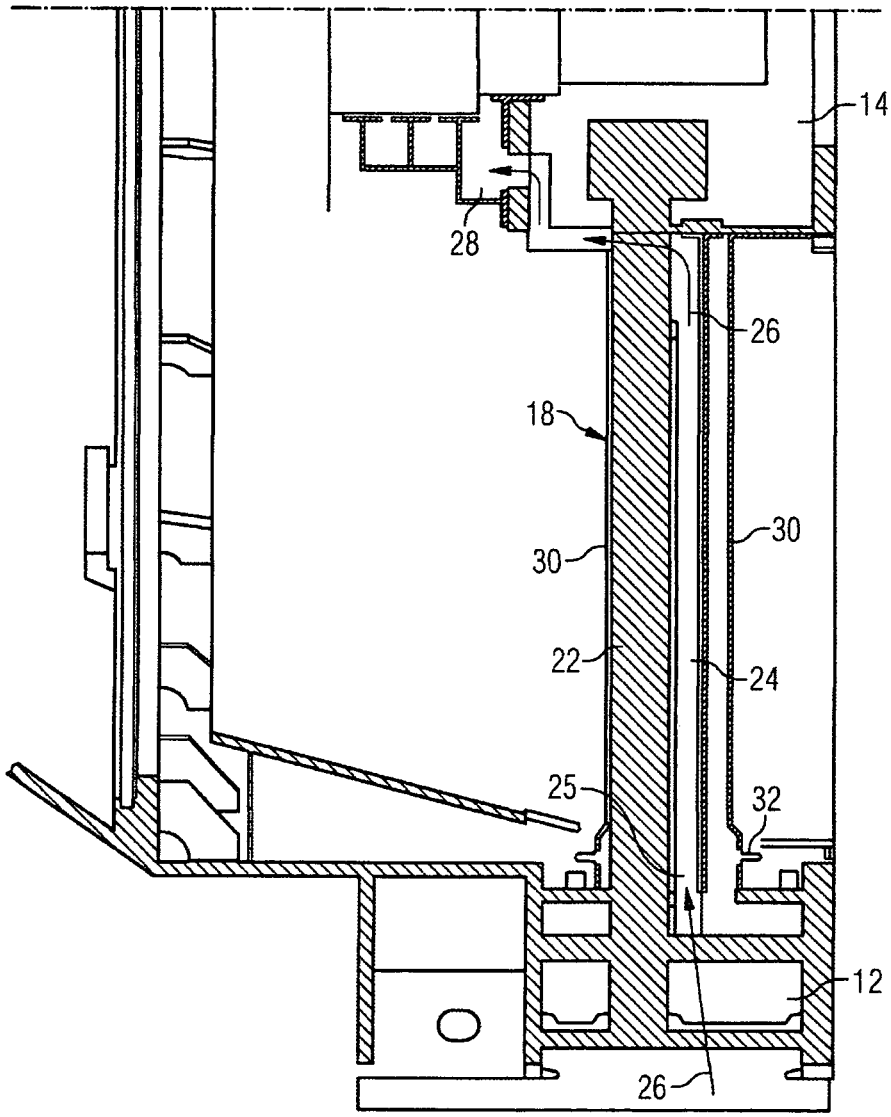
FIG. 2 shows a detailed view of the sectional view which is shown in FIG. 1 of a low-pressure steam turbine in the region of a lower load-carrying bearing strut.
Figure 3:
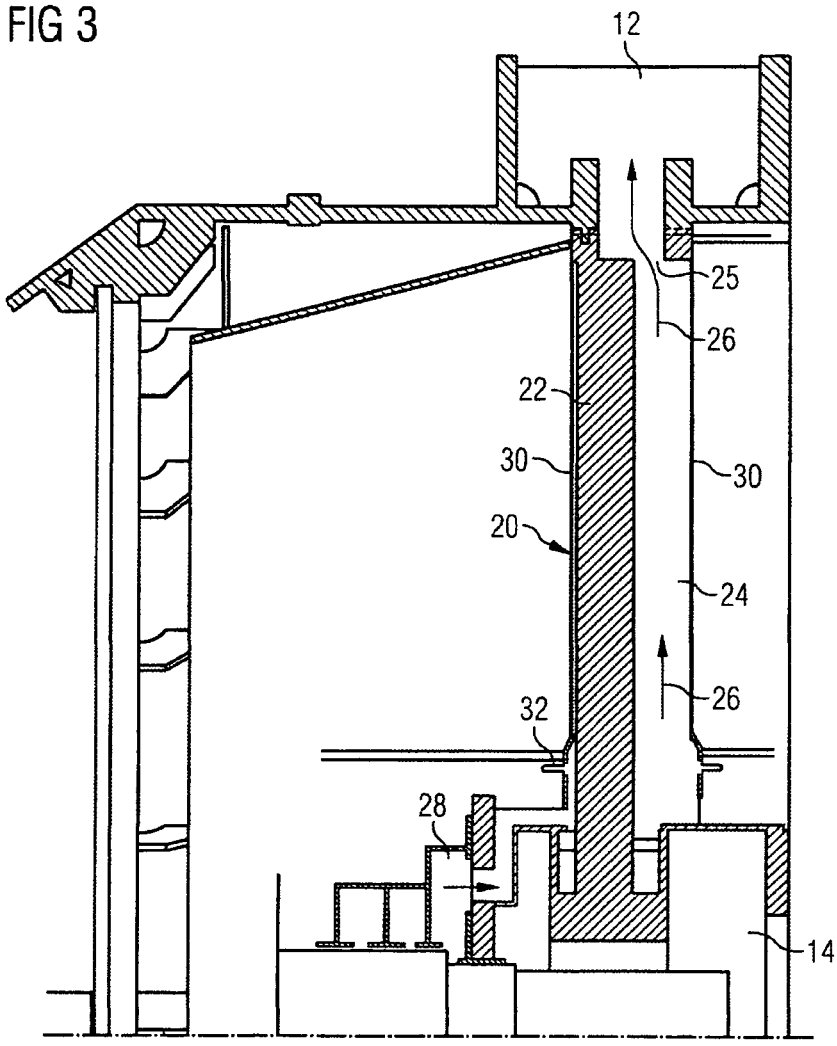
FIG. 3 shows a detailed view of the sectional view which is shown in FIG. 1 of a low-pressure steam turbine in the region of an upper bearing strut, and also
Figure 4:
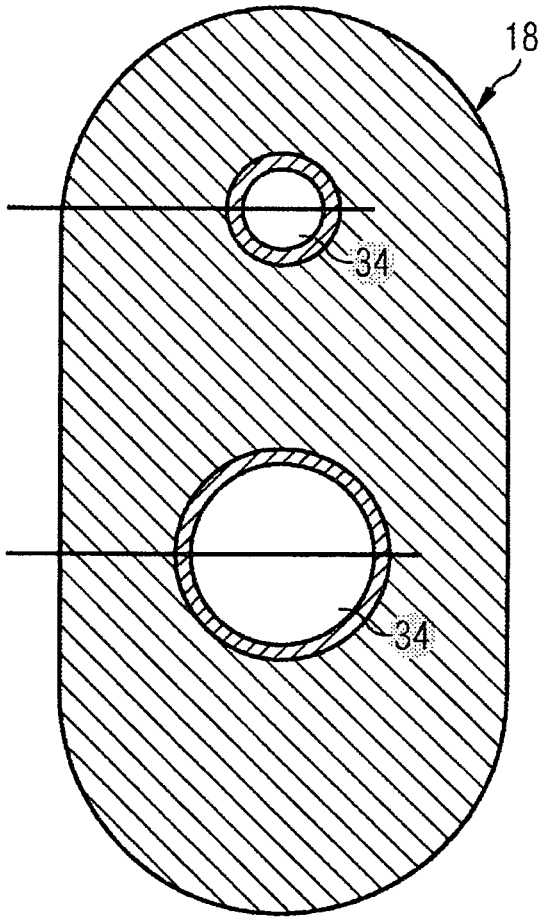
FIG 4 Prior art
FIG. 4 shows a cross-sectional view of load-carrying bearing strut which is known from the prior art.

The inner construction of one of the bearing struts 18, of the bearing strut 20, and also of the shaft seal housing 14 is shown in more detail in FIGS. 2 and 3. In FIG. 2, a detail of the low-pressure steam turbine, which is shown in FIG. 1, is shown in the region of one of the three lower load-carrying bearing struts 18. The bearing strut 18 has a solidly constructed bearing support 22 which connects the exhaust steam casing 12 to the shaft seal housing 14. A cooling cavity 24 which is constructed as a ventilation passage extends along this bearing support 22 in the longitudinal direction of the support. Furthermore, the bearing strut 18 is enclosed by a thermal insulation jacket 30 which has a compensator 32 for compensation of a length variation of the thermal insulation jacket 30. Via an access in the exhaust steam casing 12, cooling air 26 is drawn into the cooling cavity 24 of the bearing strut 18 via an opening 25 in the cooling cavity 24. After flowing through the cooling cavity 24, the cooling air 26 enters a connecting cavity 28 of the shaft seal housing 14. The connecting cavity 28 in the shaft seal housing 14 connects respective cooling cavities 24 of all the bearing struts, i.e. both the three lower bearing struts 18 and the upper bearing strut 20, in a starlike configuration. As a result, a so-called star-configured bearing pressure chamber is created, which is sealed off from the exhaust steam mass flow and exposed to throughflow with cooling air, and which comprises the cooling cavities 24 of all the bearing struts 18 and 20, and also the connecting cooling cavity 28 of the shaft seal housing 14. As shown in FIG. 1, the lower load-carrying bearing struts 18 are all exposed to throughflow with fresh air which is drawn in on the shaft seal housing side and which is then completely discharged again to the environment via the non-load-carrying upper bearing strut 20.

FIG. 3 shows a detail of the low-pressure steam turbine 10 in the region of the upper bearing strut 20. This also includes a solidly constructed bearing support 22 which connects the inner shaft seal housing 14 to the outer exhaust steam casing 12. A cooling cavity 24, which is constructed as a ventilation passage and leads into the exhaust steam casing 12 via an opening 25, is also guided along this bearing support. Since the cooling cavity 24 of the upper bearing strut 20 has to receive all the cooling air flow which is guided in the three load-carrying bearing struts 18, the cross section of the cooling cavity 24 of the upper bearing strut 20 is dimensioned to be correspondingly larger. The cooling effect of the cooling air 26 which is guided in the cooling cavity 24 of the upper bearing strut 20 is reduced compared with the cooling effect of the cooling air 26 which is guided in the load-carrying bearing struts 18, since the temperature of the cooling air 26 is already built up when passing through the lower bearing struts 18. The cooling requirement of the upper bearing strut 20, however, is less, since this, as a non-load-carrying bearing strut, is subjected to lower mechanical loads and therefore is less susceptible to deformation. In order to be able to completely develop its desired effect, the cooling system according to the invention is to be operated as shown in FIG. 1. That is to say, the cooling air flow 26 should be directed from the bottom upwards, i.e. should first pass through the lower load-carrying bearing struts 18 and then through the upper bearing strut 20 after that.

The invention claimed is:

1. A steam turbine, comprising:

an exhaust steam casing for guiding an exhaust steam mass flow;

a shaft bearing for supporting a turbine shaft; and a plurality of bearing struts having the shaft bearing fastened on the exhaust steam casing, wherein each of the plurality of bearing struts has a cooling cavity arranged in the respective bearing strut for guiding a cooling medium and the cooling cavities of the plurality of bearing struts are fluidically connected via a fluidically closed sealed connecting cavity in the region of the shaft bearing such that ambient air is drawn in through at least one of the bearing struts, passed through the connecting cavity and discharged through another bearing strut.

2. The steam turbine as claimed in claim 1, wherein the cooling cavities of the plurality of bearing struts have in each case an opening which faces the exhaust steam casing.

3. The steam turbine as claimed in claim 1, wherein the cooling cavities of the plurality of bearing struts and the connecting cavity form a pressure chamber that is sealed off from the exhaust steam mass flow of the steam turbine.

4. The steam turbine as claimed in claim 1, wherein the shaft bearing has a shaft seal housing, and the connecting cavity is further arranged inside the shaft seal housing.

5. The steam turbine as claimed in claim 1, wherein the connecting cavity is a passage system in a star-like configuration in the case of at least three bearing struts.

6. The steam turbine as claimed in claim 1, wherein at least one of the bearing struts is arranged in the lower section of the steam turbine and is a load-carrying bearing strut.

7. The steam turbine as claimed in claim 1, wherein the plurality of bearing struts are in each case as a hollow body.

8. The steam turbine as claimed in claim 1, wherein the cooling cavities extend in each case along at least one section of the corresponding strut surface in the longitudinal direction of the respective bearing strut.

9. The steam turbine as claimed in claim 1, wherein at least one seal-steam line is arranged inside the cooling cavities.

10. The steam turbine as claimed in claim 1, wherein the steam turbine is a low-pressure steam turbine with axial exhaust flow.

11. The steam turbine as claimed in claim 1, wherein the shaft bearing is a rear shaft bearing of the low-pressure steam turbine.

* * * * *